US006810818B2

(12) United States Patent
Petzl et al.

(10) Patent No.: US 6,810,818 B2
(45) Date of Patent: Nov. 2, 2004

(54) DOUBLE PULLEY DEVICE FOR USE FOR ZIP-LINE TRAVERSING ON A ROPE OR CABLE

(75) Inventors: Paul Petzl, Barraux (FR); Emmanuel D'Adhemar, Domene (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 10/462,769

(22) Filed: Jun. 17, 2003

(65) Prior Publication Data

US 2004/0020402 A1 Feb. 5, 2004

(30) Foreign Application Priority Data

Aug. 2, 2002 (FR) ..... 02 09901

(51) Int. Cl.[7] ..... B61B 3/00

(52) U.S. Cl. ..... 105/150; 105/148; 104/93; 24/375

(58) Field of Search ..... 104/115, 89, 93, 104/112, 113, 114; 105/148, 149.2, 150; 212/71, 72, 76, 77, 83, 85, 97, 98, 100, 102, 106; 16/107, 91, 92, 97, 102, 103; 24/375

(56) References Cited

U.S. PATENT DOCUMENTS 1,852,689 A * 4/1932 Baxter ..... 59/85
2,968,257 A * 1/1961 Schreyer ..... 105/150
3,037,465 A 6/1962 McIntyre
3,040,678 A 6/1962 McEwan
3,587,473 A * 6/1971 Weiss ..... 104/93
3,738,477 A * 6/1973 Gename ..... 452/187
3,759,190 A * 9/1973 Harvey ..... 105/150
3,827,367 A * 8/1974 Paglia ..... 104/93
4,062,293 A * 12/1977 Davis ..... 104/113
4,892,508 A 1/1990 Ryan et al.
5,758,392 A * 6/1998 Anscher et al. ..... 24/599.9
6,640,727 B2 * 11/2003 Ostobrod ..... 104/91

* cited by examiner

*Primary Examiner*—Mark T. Le
(74) *Attorney, Agent, or Firm*—Oliff & Berridge, PLC

(57) ABSTRACT

A double pulley device which has a pair of sheaves arranged in line inside a reverse U-shaped metal support flange-plate, each sheave being mounted rotating free on a fixed spindle of the flange-plate. At least one orifice for the passage of a snap-hook, is situated between the two spindles of the sheaves, so that the fixing point of the snap-hook is positioned above the point of contact of the sheaves with the cable. One of the wings of the flange-plate is arranged to enable the mobile finger of the snap-hook to be opened when the double pulley device is fitted onto the cable.

7 Claims, 5 Drawing Sheets

DOUBLE PULLEY DEVICE FOR USE FOR ZIP-LINE TRAVERSING ON A ROPE OR CABLE

BACKGROUND OF THE INVENTION

The invention relates to a double pulley device for use for Tyrolean traversing on a rope or cable comprising:

a pair of sheaves arranged in line inside a reverse U-shaped metal support flange-plate, each sheave being mounted rotating free on a fixed spindle of the flange-plate, and means for fitting the flange-plate to an attachment snap-hook.

STATE OF THE ART

In double pulley devices used for Tyrolean or zip-line traversing, it is conventional to fit an attachment snap-hook in orifices situated at the bottom part of the flange-plate. The fixing point of the snap-hook is located under the point of contact of the sheaves with the cable. Fitting or removing the double pulley device necessarily requires the snap-hook to be removed, with risks of losing the pulley in the event of a handling error.

SUMMARY OF THE INVENTION

An object of the invention is to achieve a double pulley device that is easy to fit and remove and that provides maximum safety when used for Tyrolean traversing.

The device according to the invention is characterized in that the means for fitting the flange-plate comprise at least one orifice for passage of the snap-hook situated between the two spindles of the sheaves so that the fixing point of the snap-hook is positioned above the point of contact of the sheaves with the cable, one of the wings of the flange-plate being arranged to enable the mobile finger of the snap-hook to be opened when the double pulley device is fitted onto the cable.

According to a preferred embodiment of the invention, one of the wings of the flange-plate situated on the same side as the mobile finger of the snap-hook is shorter than the other wing. The two wings of the flange-plate are curved outwards to form a funnel enabling the cable to be fitted quickly on the sheaves. The bottom end of the longer wing is arranged as a stop for stable positioning of the snap-hook in a vertical position perpendicular to the flange-plate. The diameter of each sheave is larger than that of the orifices for passage of the snap-hook.

According to one feature of the invention, a deformable part is housed in the orifices to achieve captive fitting of the snap-hook.

According to another feature of the invention, the sheaves are fitted rotating on ball-bearings or self-lubricating bearings.

BRIEF DESCRIPTION OF THE DRAWINGS

Other advantages and features will become more clearly apparent from the following description of an embodiment of the invention given as a non-restrictive example only and represented in the accompanying drawings, in which.

DESCRIPTION OF A PREFERRED EMBODIMENT

Figure 1:
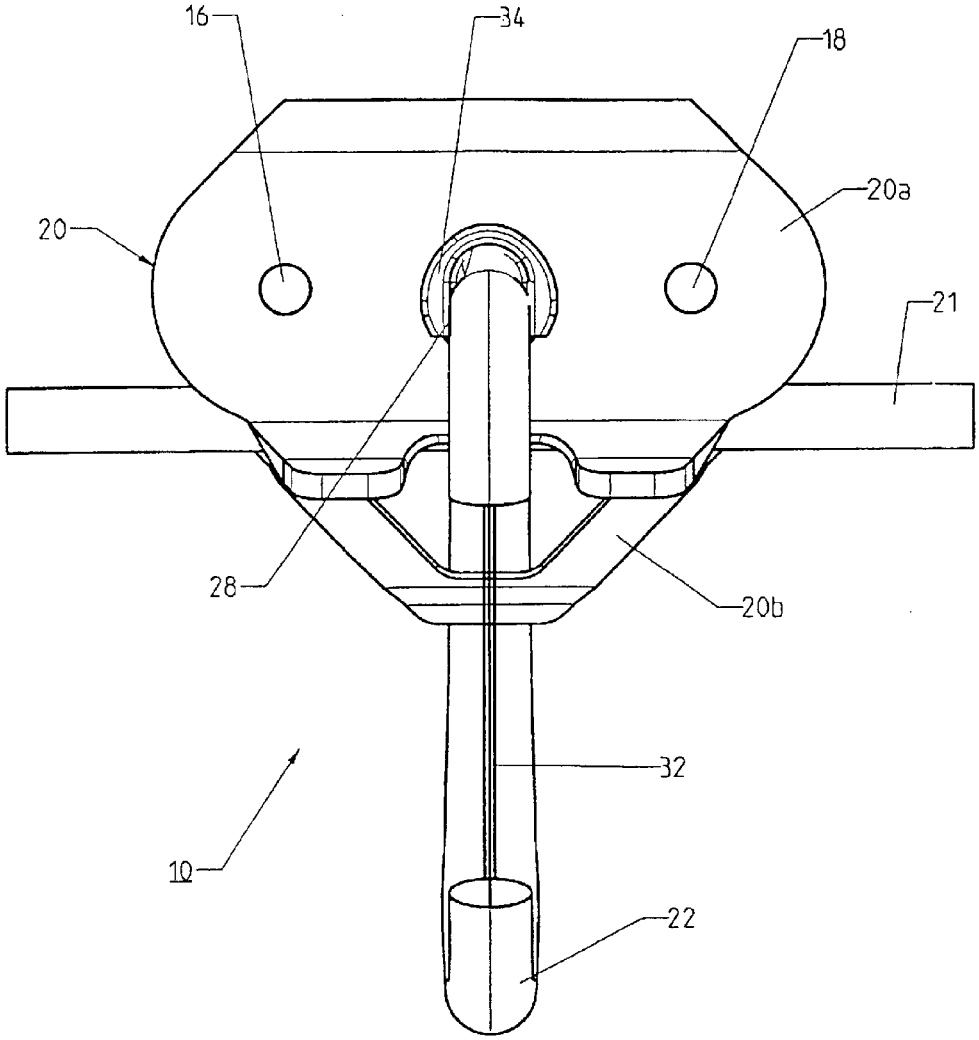
FIG. 1 is an elevation of the double pulley device according to the invention.

With reference to the figures, a double pulley device 10 comprises a pair of sheaves 12, 14 of identical structures, mounted in line and rotating free on two fixed spindles 16, 18 securedly affixed to a reverse U-shaped metal support flange-plate 20. Such a device is used for aerial transport of a person when performing Tyrolean traversing on a belaying rope or cable 21.

An attachment snap-hook 22 is inserted into a pair of aligned orifices 24, 26 arranged in the parallel wings 20*a*, 20*b* of the flange-plate 20. The orifices 24, 26 are located substantially in a plane passing through the spindles 16, 18 and extending in a direction parallel to the cable 21. The diameter of each sheave 12, 14 is larger than that of the orifices 24, 26 so that the fixing point 28 of the snap-hook 22 onto the flange-plate 20 is positioned above the point of contact 30 of the sheaves 12, 14 on the cable 21.

Figure 2:
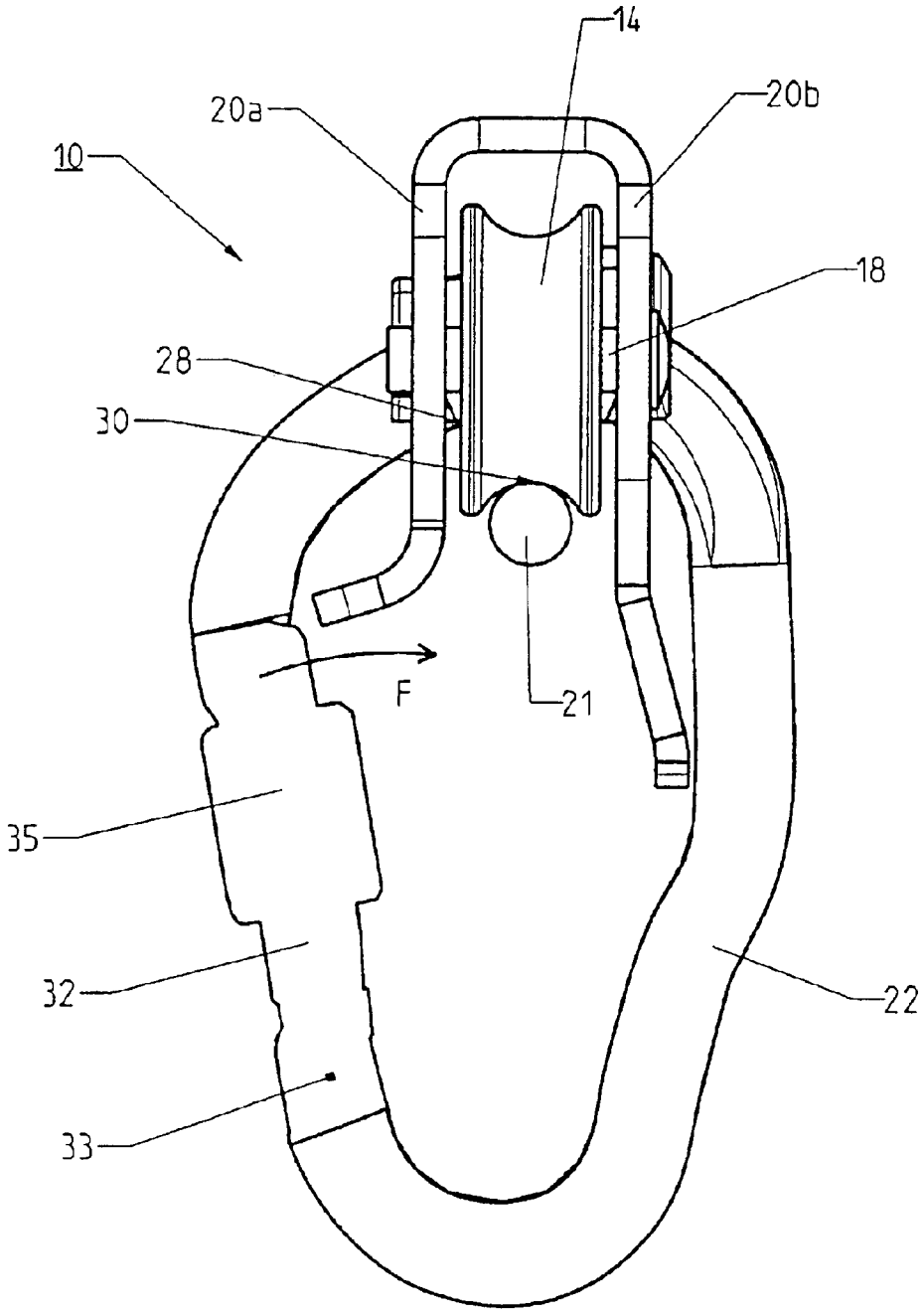
FIG. 2 is a side view of FIG. 1.
Figure 3:
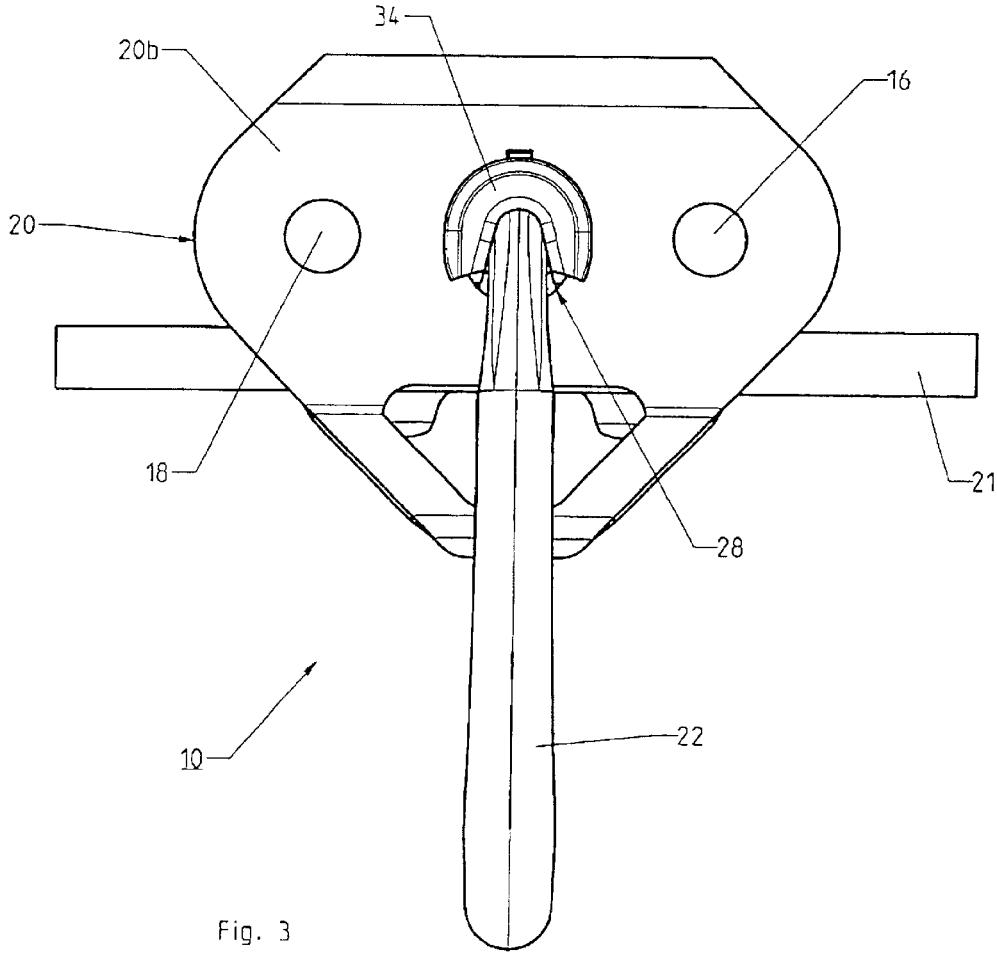
FIG. 3 shows a rear view of FIG. 1.
Figure 4:
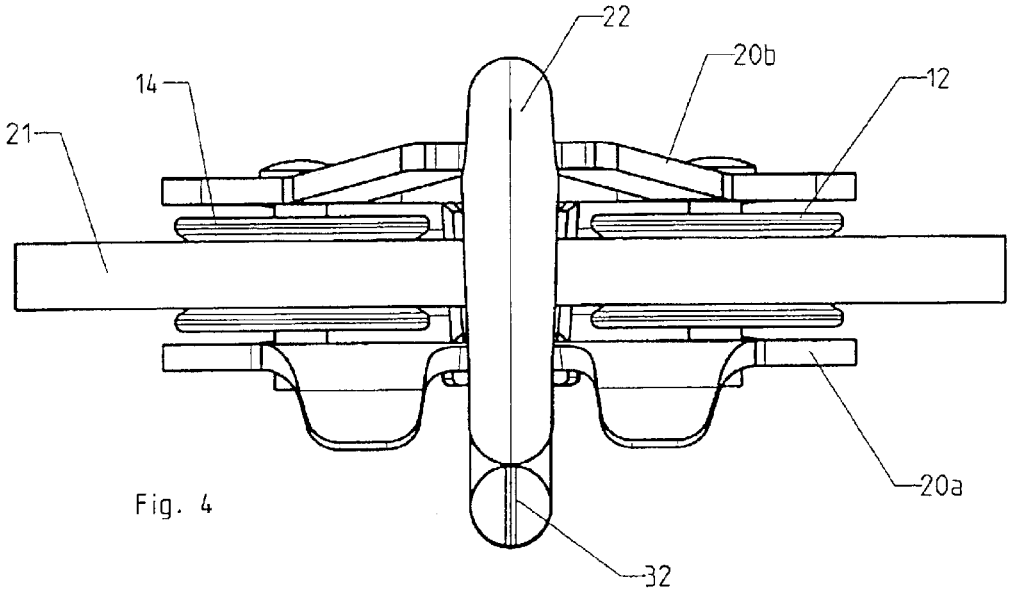
FIG. 4 represents a bottom view of FIG. 3.
Figure 5:
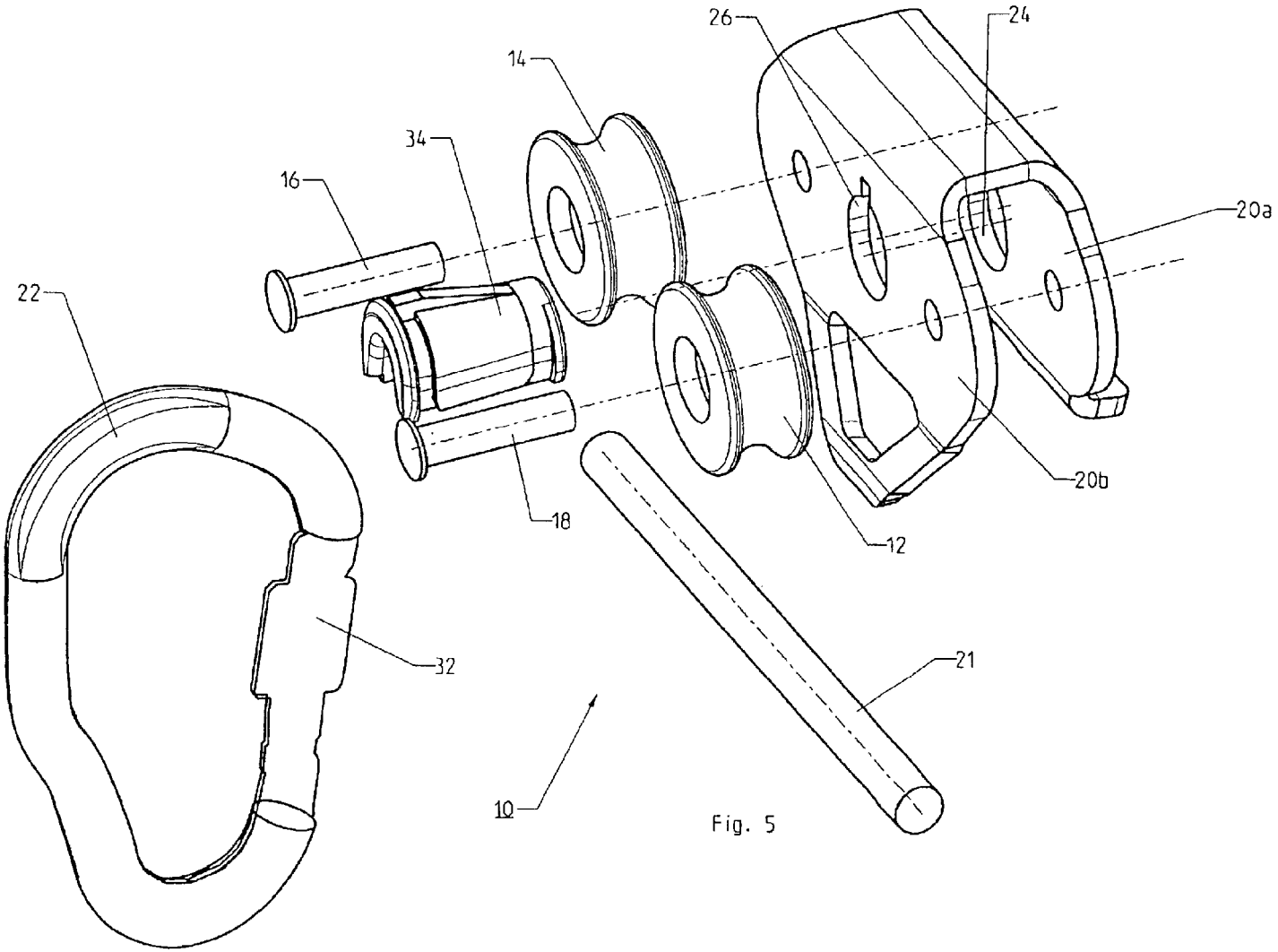
FIG. 5 is an exploded perspective view of the double pulley device.

One of the wings 20*a* situated on the same side as the mobile finger 32 of the snap-hook 22 is shorter than the other wing 20*b* to allow the finger 32 to be opened towards the inside of the snap-hook when the device 10 is fitted onto the cable 21. The finger 32 is mounted pivoting on a spindle 33 of the snap-hook body and is biased to the closed position by a return spring (not shown). It is equipped in addition with a locking ring 35 (FIG. 2) to lock the finger 32 in the closed position during use.

The bottom parts of the two wings 20*a*, 20*b* of the flange-plate 20 are curved outwards to form a funnel enabling the cable 21 to be fitted quickly on the sheaves 12, 14. The end of the wing 20*b* is arranged as a stop to ensure stable positioning of the snap-hook 22 in a vertical position perpendicular to the flange-plate 20.

This position of the snap-hook 2 is rendered captive by insertion of a semi-cylindrical deformable part 34, in particular made of rubber, in the orifices 24, 26 of the wings 20*a*, 20*b*.

The sheaves 12, 14 are made of stainless steel or aluminum and can be fitted rotating on ball-bearings or self-lubricating bearings.

Implementation of the double pulley device 10 on the cable 21 is performed in the following manner:

The body of the snap-hook 22 is fitted in place in the orifices 24, 26 of the support flange-plate 20, and does not need to be removed for the cable 21 to be placed in position. The finger 32 simply has to be pivoted inwards (arrow F, FIG. 2) to allow the cable 21 to pass to the inside of the flange-plate 20 and come into engagement on the point of contact 30 with the sheaves 12, 14. This results in locking of the cable 21 on the device 10, which takes place inside the snap-hook 22 itself. The latter is captive given that it forms a monoblock assembly with the flange-plate 20 that does not need to be dissociated during use. For the cable 21 to be inserted or removed, the mobile finger 32 merely has to be opened while the body of the snap-hook 22 remains in place.

Use of the double pulley device 10 for Tyrolean traversing thus enables good stability and maximum safety to be achieved.

What is claimed is:

1. A double pulley device for use for zip-line traversing on a rope or cable comprising:

a pair of sheaves arranged in line inside a reverse U-shaped metal support flange-plate, each sheave being mounted rotating free on a fixed spindle of the flange-plate, and means for fitting the flange-plate to an attachment snap-hook, wherein the means for fitting the flange-plate comprise at least one orifice for passage of the snap-hook situated between the two spindles of the sheaves so that a fixing point of the snap-hook is positioned above a point of contact of the sheaves with the cable, one of a plurality of wings of the flange-plate being arranged to enable a mobile finger of the snap-hook to be opened when the double pulley device is fitted onto the cable and wherein one of the wings of the flange-plate situated on the same side as the mobile finger of the snap-hook is shorter than the other wing.

2. The double pulley device according to claim 1, wherein a deformable part is housed in said orifice to achieve captive fitting of the snap-hook.

3. The double pulley device according to claim 1, wherein the sheaves are fitted rotating on at least one of ball-bearings and self-lubricating bearings.

4. The double pulley device according to claim 1, wherein the diameter of each sheave is larger than that of the at least one orifices for passage of the snap-hook.

5. A double pulley device for use for zip-line traversing on a rope or cable, comprising:

a pair of sheaves arranged in line inside a reverse U-shaped metal support flange-plate, each sheave being mounted rotating free on a fixed spindle of the flange-plate; and means for fitting the flange-plate to an attachment snap-hook, wherein the means for fitting the flange-plate comprise at least one orifice for passage of the snap-hook situated between two spindles of the sheaves so that a fixing point of the snap-hook is positioned above a point of contact of the sheaves with the cable, one of a plurality of wings of the flange-plate being arranged to enable a mobile finger of the snap-hook to be opened when the double pulley device is fitted onto the cable, wherein two of the plurality of wings of the flange-plate are curved outwards to form a funnel enabling the cable to be fitted quickly on the sheaves.

6. A double pulley device for use for zip-line traversing on a rope or cable, comprising:

a pair of sheaves arranged in line inside a reverse U-shaped metal support flange-plate, each sheave being mounted rotating free on a fixed spindle of the flange-plate; and means for fitting the flange-plate to an attachment snap-hook, wherein the means for fitting the flange-plate comprise at least one orifice for passage of the snap-hook situated between two spindles of the sheaves so that a fixing point of the snap-hook is positioned above a point of contact of the sheaves with the cable, one of a plurality of wings of the flange-plate being arranged to enable a mobile finger of the snap-hook to be opened when the double pulley device is fitted onto the cable, wherein a bottom end of a longer wing is arranged as a stop for stable positioning of the snap-hook in a vertical position perpendicular to the flange-plate.

7. A double pulley device for use for zip-line traversing on a rope or cable, comprising:

a pair of sheaves arranged in line inside a metal support flange-plate, each sheave being mounted rotating free on a fixed spindle of the flange-plate;

an attachment snap-hook having a mobile finger, the snap-hook being attachable to the flange-plate by means comprising two aligned orifices for passage of the snap-hook which is situated perpendicularly in a vertical position between the two spindles of the sheaves, so that a fixing point of the snap-hook is positioned above a point of contact of the sheaves with the cable, one of a plurality of wings of the flange-plate being arranged to enable said mobile finger of the snap-hook to be opened when the double pulley device is fitted onto the cable, wherein the snap-hook forms an endless loop extending from the fixing point to the lowest point of the snap-hook.

* * * * *